US005377592A

United States Patent [19]

Rode et al.

[11] Patent Number: 5,377,592

[45] Date of Patent: Jan. 3, 1995

[54] IMPULSE SIGNAL DELAY UNIT

[75] Inventors: Kenneth A. Rode, Burlington; Robert G. Pallanck, Windsor; Dorman, Mark D., East Grandby; Richard J. Michna, Winsted, all of Conn.

[73] Assignee: The Ensign-Bickford Company, Simsbury, Conn.

[21] Appl. No.: 949,466

[22] Filed: Sep. 22, 1992

Related U.S. Application Data

[63] Continuation-in-part of Ser. No. 730,275, Jul. 9, 1991, Pat. No. 5,173,569.

[51] Int. Cl.[6] ..... F42C 11/02

[52] U.S. Cl. ..... 102/210; 102/206

[58] Field of Search ..... 102/200, 206, 207, 210, 102/318

[56] References Cited

U.S. PATENT DOCUMENTS

| | | | |
|---|---|---|---|
| 3,340,811 | 9/1967 | Gauld | 102/210 |
| 3,610,153 | 10/1971 | Betts | 102/220 |
| 3,741,124 | 6/1973 | Visk | 102/220 |
| 3,885,501 | 5/1975 | Schneider, Jr. | 102/218 |
| 3,981,240 | 9/1976 | Gladden | 102/202.4 |
| 3,987,729 | 10/1976 | Andrews et al. | 102/210 |
| 3,987,732 | 10/1976 | Spraggs et al. | 102/275.5 |
| 4,328,751 | 5/1982 | Oswald | 102/220 |
| 4,393,779 | 7/1983 | Brede et al. | 102/202.5 |
| 4,395,950 | 8/1983 | Oswald | 102/200 |
| 4,445,435 | 5/1984 | Oswald | 102/215 |
| 4,481,884 | 11/1984 | Yunan | 102/313 |
| 4,607,573 | 8/1986 | Thureson et al. | 102/275.8 |
| 4,617,866 | 10/1986 | Simpson | 102/262 |
| 4,632,031 | 12/1986 | Jarrott et al. | 102/200 |
| 4,674,047 | 6/1987 | Tyler et al. | 102/206 |
| 4,730,556 | 3/1988 | Cobbs | 101/129 |
| 4,742,773 | 5/1988 | Bartholomew | 102/275.3 |
| 4,757,764 | 7/1988 | Thureson et al. | 102/312 |
| 5,173,569 | 12/1992 | Pallanck et al. | 102/210 |

FOREIGN PATENT DOCUMENTS

| | | |
|---|---|---|
| 67080 | of 1990 | Australia . |
| 2206640 | 8/1972 | Germany . |
| 8364165 | 8/1983 | South Africa . |
| 896536 | 8/1988 | South Africa . |
| 896936 | 9/1989 | South Africa . |
| 8901601 | 2/1989 | WIPO . |
| 9200498 | 1/1992 | WIPO . |

*Primary Examiner*—Ian J. Lobo

*Attorney, Agent, or Firm*—Victor E. Libert; Frederick A. Spaeth

[57] ABSTRACT

A digital delay unit for use in blasting operations and the like provides a selected delay between an input impulse signal and an output impulse signal. The delay unit may have a fixed, preset electronically controlled delay period or, optionally, is programmable to enable user-selected changes in an electronically controlled delay lay period. The delay unit has a housing which serves to connect the input and output transmission lines and house the other components, which includes a piezoelectric transducer which converts the input impulse energy, or the energy released by detonation of a booster charge by the input impulse energy, to electrical energy which is used to generate a first electric signal and a second electric signal. An electronic circuit is responsive to the first electric signal to start counting a preprogrammed delay period, after which a second electric signal is emitted to detonate an output charge which ignites one or more output transmission lines, e.g., shock tubes.

29 Claims, 5 Drawing Sheets

IMPULSE SIGNAL DELAY UNIT

This is a continuation-in-part of copending application(s) Ser. No. 07/730,275 filed on Jul. 9, 1991 now U.S. Pat. No. 5,173,569.

BACKGROUND OF THE INVENTION

1. Field of the Invention

This invention relates to delay devices for use with non-electric signal transmission lines of the type used in blasting operations, and more specifically to electronically controlled delay devices.

2. Background and Related Art

Blasting operations normally involve sequentially-timed detonations of explosive charges placed within bore-holes drilled into, for example, a rock or an ore mass to be fragmented. Generally, one or more transmission lines are deployed from a central initiating point to send a signal to detonate the individual blasting charges located within the respective boreholes. These transmission lines may consist of one or more main trunklines connected to a plurality of "downlines" leading from the trunklines into the boreholes to transmit the initiating signal to a detonator cap, sometimes referred to as a blasting cap, which, upon detonation, detonates the main explosive charge within the borehole.

The timing of sequential detonations within each borehole must be closely controlled to achieve the desired fragmentation and movement of ore and/or rock and to reduce noise and vibration. The desired time intervals between detonations are usually measured in milliseconds to achieve the desired results. Generally, at least an eight millisecond delay is employed between adjacent boreholes but significantly longer delays, e.g., 25, 50, 250 or 500 milliseconds, are often used. The desired timing of sequential detonations may be at least in part obtained by the use of blasting caps and, in some cases, signal transmission caps, which provide preselected delay periods between the receipt of the incoming signal and detonation of the caps. The provision of selected delays within blasting and signal transmission caps is well illustrated in Spraggs et al U.S. Pat. No. 3,987,732.

In many cases it is also necessary to provide one or more delays in the transmission of signals along the transmission lines and this may be accomplished by utilizing signal delay units in the transmission lines. The transmission lines may comprise conventional combustible fuses, explosive detonating cords, non-destructive signal transmission tubes, or combinations thereof, sometimes with supplementary charges utilized to ensure transmission of the signal between transmission lines at connection points. A supplementary charge device is disclosed in U.S. Pat. No. 4,481,884.

Conventional detonating cords are noisy and have a tendency to throw debris and shrapnel from destroyed connectors and the like, which may result in cutting the transmission line ahead of the signal, thereby disrupting the desired blasting pattern. These disadvantages in a transmission line may be overcome by the utilization of known, non-destructive signal transmission lines. One type is commonly referred to as "shock tube" and is illustrated in Thureson et al U.S. Pat. No. 4,607,573. Other non-destructive transmission lines include low velocity signal transmission tubes as illustrated in Thureson et al U.S. Pat. No. 4,757,764. Shock tube and low velocity signal transmission tube ("LVST tube") generally comprise hollow, plastic tubing which is coated on its interior surface with a thin layer of a suitable explosive (shock tube) or deflagrating composition (LVST tube). Upon initiation of the explosive or deflagrating composition within such signal transmission tubes, a shock wave, flame front or other such impulse signal is transmitted through the tube. This impulse signal may be utilized to detonate signal transmitting and blasting caps in order to initiate timed detonation of the main charges.

The use of pyrotechnic delay devices in signal transmission lines is known in the art. For example, a pyrotechnic delay unit for a signal transmission tube is shown in U.S. Pat. No. 4,742,773, issued to Bartholomew et al, on May 10, 1988. This Patent calls for using, in a signal transmission tube, a delay assembly comprising a delay element which contains a shaped pyrotechnic delay composition having a preselected combustion time. As described beginning at column 3, line 49 of the Bartholomew Patent, signal transmission tubes are received in the opposite ends of the delay assembly and connected to opposite ends of the delay element. An incoming impulse signal from one of the transmission tubes connected to the assembly initiates the timed combustion of the delay element, starting at one end thereof. The combustion time of the delay element may range from nine milliseconds to ten seconds or longer, depending on the delay composition utilized (column 4, lines 11–15). When the combustion proceeds from one end to the other end of the delay element, the preselected delay period will have elapsed and the burning delay element ignites the other, outgoing signal transmission tube. Consequently, a selected delay in timing of transmission of the signal through the transmission tube connected by the delay unit is attained. The pyrotechnic delay assembly of the Bartholomew Patent employs transition and delay chemical compositions comprising various reactive chemical compounds, as explained beginning at column 4, line 38.

Pyrotechnic delays such as those utilized in the Bartholomew Patent exhibit inherent variations in combustion time and hence in the desired delay interval. Consequently, the actual delay period of a given delay unit varies within a range of deviation from the nominal delay period of the unit. These variations are caused by compositional and manufacturing tolerances which are unavoidable as a practical matter in mass-produced pyrotechnic delay units and result in deviations sometimes referred to as "time scatter" in the planned timing of the sequence of detonations, and consequent poor blasting results. If the planned time interval between sequential detonations is very short, the time scatter may approach or even exceed the planned intervals, thus resulting in out-of-sequence detonations. Further, if it is desired to change the time delay of a given assembly, that can be accomplished only by replacing pyrotechnic delay units of a given delay period with pyrotechnic delay units of a different delay period. One must therefore maintain an inventory of pyrotechnic delay units of different delay periods in order to have the necessary flexibility in designing blasting patterns.

Electric blasting systems, in which sequential blasting machines are electronically controlled to deliver closely timed electrical signals to electrically activated instantaneous blasting caps do not have such time scatter problems. However, the use of electrical means as the sole source for timing the detonations makes it impossible to apply all of the signal pulses to a large number of charges prior to the detonation of the first charge, and this poses the danger that one or more electrical connections will be broken by the earlier explosions before the signal is delivered to the remaining charges. Further, electrical blasting systems present electrocution hazards and the possibility of premature or unintended detonations caused by static electricity and induced currents caused by power lines, ground currents or other sources.

PARENT PATENT APPLICATION

U.S. patent application Ser. No. 07/730,275, the parent of this application, describes the attainment of delayed detonation of a charge in response to the arrival of an incoming pressure pulse from a shock tube through the use of an electronically timed delay within a blasting cap. The parent application, now U.S. Pat. No. 5,173,569, details the use of a piezoelectric element responsive to pressure wave from an incoming signal transmission tube to power an electronic circuit providing a single, specific, solid state controlled time delay for the detonation of the blasting cap. The detonation time for the blasting cap in each individual borehole can be controlled in response to an initiating pressure pulse.

SUMMARY OF THE INVENTION

The delay units of the present invention provide electronically controlled delay periods of great accuracy, e.g., as great as plus or minus one millisecond, depending on the duration of the delay period. Such accuracy is far superior to that of pyrotechnic type delays. Generally, the present invention provides a delay unit in which the timing and generation of a non-electrical output signal is initiated by electrical energy from a transducer which is actuated by a non-electrical input impulse signal, such as a shock wave or explosion.

Specifically, in accordance with the present invention there is provided a delay unit comprising a housing having the following components: (i) an input line retainer means for retaining an input transmission line capable of transmitting an input impulse signal; (ii) a coupling means for coupling the input transmission line to a signal conversion means (e.g., to a transducer such as a piezoelectric generator connected to an energy storage means) for converting an impulse signal from the input transmission line to electrical energy and releasing the electrical energy as a first electric signal and a subsequent second electric signal; (iii) a first conductor means connecting the signal conversion means to a delay circuit for transmitting thereto the first electric signal to activate the delay circuit to start counting a selected time interval; (iv) a second conductor means connecting the signal conversion means via the delay circuit to an electrically detonatable output charge for transmitting, upon lapse of the selected time interval, the second electric signal to detonate the output charge; and (v) one or more output line retainer means for retaining one or more output transmission lines in proximity to the output charge so that detonation of the output charge ignites the one or more output transmission lines.

One aspect of the present invention provides a transducer within the signal conversion means for converting the input impulse signal to electrical energy, and energy storage means connected to the transducer to receive electrical energy for release as the first electrical signal and the second electrical signal.

In a further aspect of the invention, the coupling means may comprise the booster charge and the transducer may be pressurized by detonation of the booster charge.

In accordance with another aspect of the present invention, the coupling means includes a booster charge which is positioned to be detonated by the input impulse signal received from the input transmission line to pressurize the transducer and thereby generate the electrical energy.

In one aspect of the invention, the delay circuit comprises a battery connected to provide power to an oscillator for generating cycles, a counter operatively connected to the oscillator for counting the cycles, and a means for preloading the counter with an initial value.

In one aspect of the invention the delay circuit may comprise a voltage regulator connected to the energy storage means to receive power therefrom, an oscillator for generating cycles connected to the voltage regulator to receive power therefrom, a counter connected to the oscillator for counting the cycles, and a means for preloading the counter with an initial value.

In another aspect of the present invention, the delay circuit comprises a battery means to supply power to the delay circuit upon activation thereof by the first electric signal. In this aspect, the delay circuit may comprise the battery means, connected to an oscillator to provide power thereto for generating cycles, a counter connected to the oscillator for counting the cycles, and means for preloading the counter with an initial valve.

Yet another aspect of the present invention includes the provision of programming means carried by the housing and effective to program the duration of the time interval of the delay circuit. In certain aspects of the present invention the programming means may be accessible from the exterior of the housing and the delay unit may include an interface connector connecting the programming means to the delay circuit so that the duration of the time interval of the delay circuit may be programmed. In this aspect, the interface connector may comprise an inductive pick-up means or an optical coupling means.

The present invention also provides that the delay unit may include an input transmission line, e.g., a transmission tube such as a shock tube, or a detonating cord, which is retained by the input line retainer means. In another aspect, the delay unit may also include one or more output transmission tubes retained by one or more of the output line retainer means.

In accordance with the present invention there is also provided a method for interposing a time delay between the application of an input impulse signal received from an input transmission line, e.g., a shock tube, and the generation of one or more output impulse signals via one or more output transmission lines, e.g., shock tubes. The method comprises the following steps: The input impulse signal is converted to a first electric signal, e.g., by using it to pressurize a piezoelectric generator, and the first electric signal is transmitted to an oscillator. (The input impulse signal may optionally be amplified by using it to detonate a booster charge which pressurizes the piezoelectric generator.) The number of cycles generated by the oscillator in response to the first electric signal is counted and a second electric signal is generated upon the completion of a preprogrammed count of the number of the cycles. The second electric signal is then transmitted to an electrically operable output charge to detonate the output charge. The detonator of the output charge ignites one or more output transmission tubes with the energy generated by the detonation to transmit one or more output impulse signals through the output transmission tubes.

Other aspects of the present invention will be apparent from the following description and drawings.

DETAILED DESCRIPTION OF THE INVENTION AND PREFERRED EMBODIMENTS THEREOF

The signal delay units of the present invention provide accurate, electronically controlled delay periods. Although sometimes referred to as "in-line delay units", alluding to their use in blasting signal transmission lines, the signal delay units of the present invention may also be employed in conjunction with an instantaneous blasting cap to serve as a delay blasting cap, for example, in systems such as that of the aforementioned Spraggs et al U.S. Pat. No. 3,987,732. Thus, the signal delay units of the present invention find utility both as in-line delay units and as delay units for individual detonation caps. In certain embodiments of the present invention the delay period may be selected by the user by simple programming of the delay unit. In such case, in addition to enhanced accuracy of the timing of the delay periods, a single delay unit may be carried in stock to replace an entire inventory of preset in-line delay units provided by conventional pyrotechnic delay units. The provision of an electronic delay means by the delay units of the present invention eliminates the need for pyrotechnic delay elements, and significantly reduces the amount of lead and delay chemical compounds .(which include suspected carcinogens) dispersed at blasting sites by the use of pyrotechnic delay units.

Figure 1:
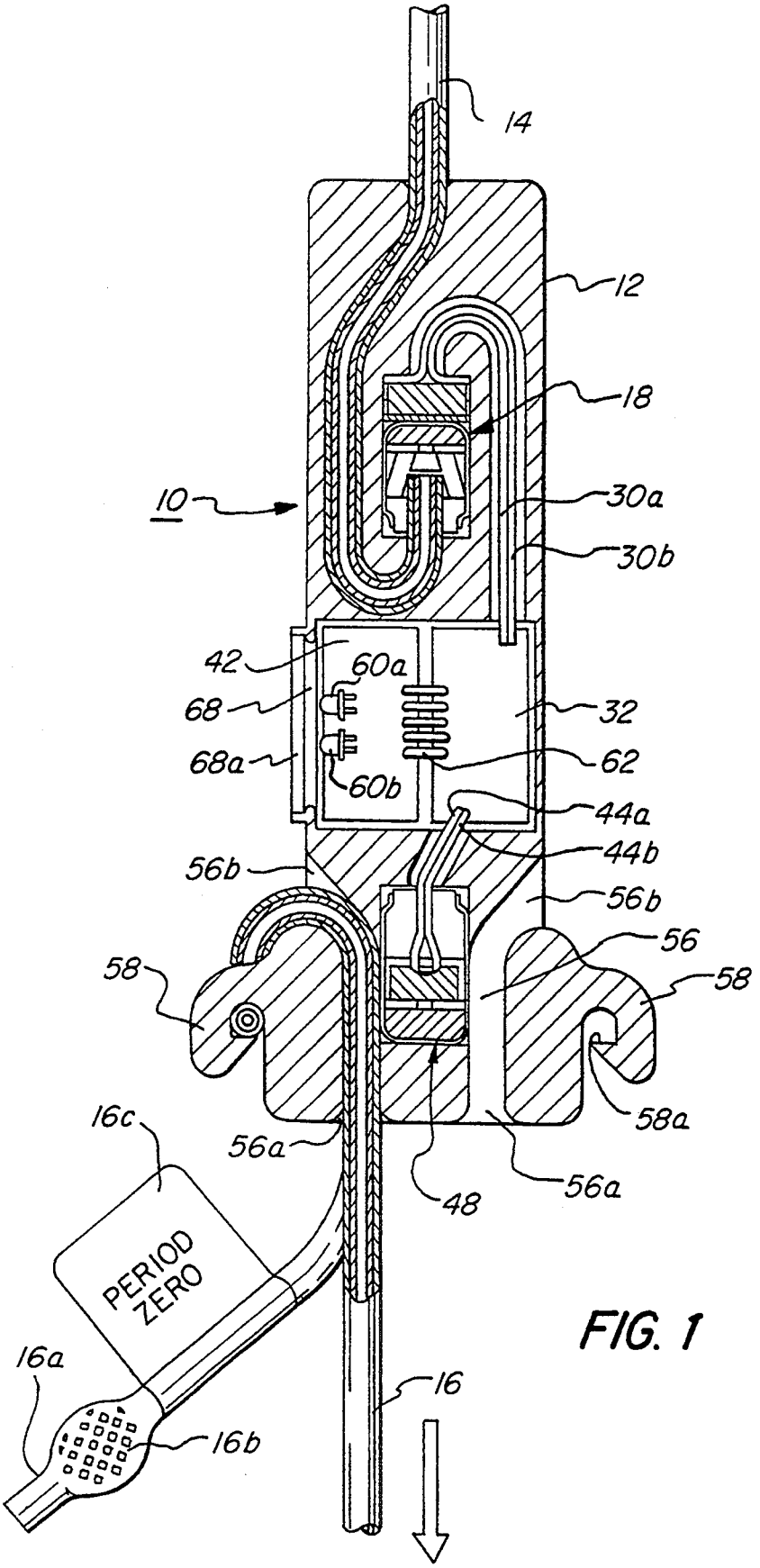
FIG. 1 is a schematic cross-sectional view showing one embodiment of a delay unit of the present invention including an input transmission line and an output transmission tube attached thereto.

FIG. 1 shows one embodiment of an in-line delay unit 10 of the present invention. A housing 12, which may be made of any suitable dielectric material such as a synthetic organic polymer (plastic), for example, polyethylene or other thermoplastic material, contains the other components of the in-line delay unit in suitable cavities formed in housing 12. Housing 12 also serves to receive and connect the input and output transmission lines. In the illustrated embodiment, the input transmission line is provided by an input shock tube 14 and the output transmission line is provided by an output shock tube 16. A suitable inlet bore (unnumbered) is formed in housing 12 and receives and securely retains the input transmission shock tube 14, as described in more detail below. Input shock tube 14 comprises a hollow plastic tube, the inner surface of which is coated by an explosive powder layer **14*a* (FIG. 1A). Input shock tube 14 terminates within housing 12 adjacent to a booster charge 26**.

Low energy booster detonator 18 (FIGS. 1 and 1A) comprises a detonator shell 20, within which are disposed an anti-static cup 22, a first cushion element 24, and a booster charge 26. A transducer which, in the illustrated embodiment, comprises a piezoelectric generator 28, and a first conductor means which, in the illustrated embodiment, comprises a pair of leads **30*a*, 30*b* are mounted within housing 12 adjacent to low energy booster detonator 12. Detonator shell 20 is crimped around a bushing 31 within which input shock tube 14 is received to help retain the end of the shock tube securely in place within low energy booster detonator 18. In addition, the one hundred eighty-degree return bend configuration of the inlet bore (FIG. 1) which receives input shock tube 14 provides a strain relief which helps to hold input shock tube 14 firmly in place within housing 12. This emplacement of input shock tube 14 within housing 12, which is usually carried out in factory assembly of the device, resists the tendency of mechanical forces to dislodge input shock tube 14 from housing 12**.

As best seen in FIG. 1A, booster charge 26 is separated from anti-static cup 22 by first cushion element 24, the function of which is to distribute, during factory assembly of booster detonator 18, the pressure of a steel pin used to insert booster charge 26 into detonator shell 20. This distribution of pressure reduces the chance of detonation of booster charge 26 during the manufacturing process. First cushion element 24 has a central aperture **24*a* formed therein and closed by a thin, rupturable membrane (unnumbered) to seal booster charge 26. Central aperture 24*a* provides a low-resistance path to booster charge 26 for the impulse signal delivered by input shock tube 14**.

Anti-static cup 22 is made of a semi-conductive material such as a carbon-filled polymeric material and is in the shape of a truncated cone with a thin, rupturable membrane **22*a* extending across its midsection and against which the end of input shock tube 14 is seated, providing an air-gap "stand-off" between the end of input shock tube 14 and booster charge 26. Anti-static cup 22 contacts the sides of detonator shell 20 and serves to ground any electrostatic discharge traveling through input shock tube 14 against shell 20 to eliminate the possibility of an electrostatic charge prematurely detonating booster charge 26**. The use of such anti-static cup devices is known in the art (see Gladden U.S. Pat. No. 3,981,240).

Figure 2:
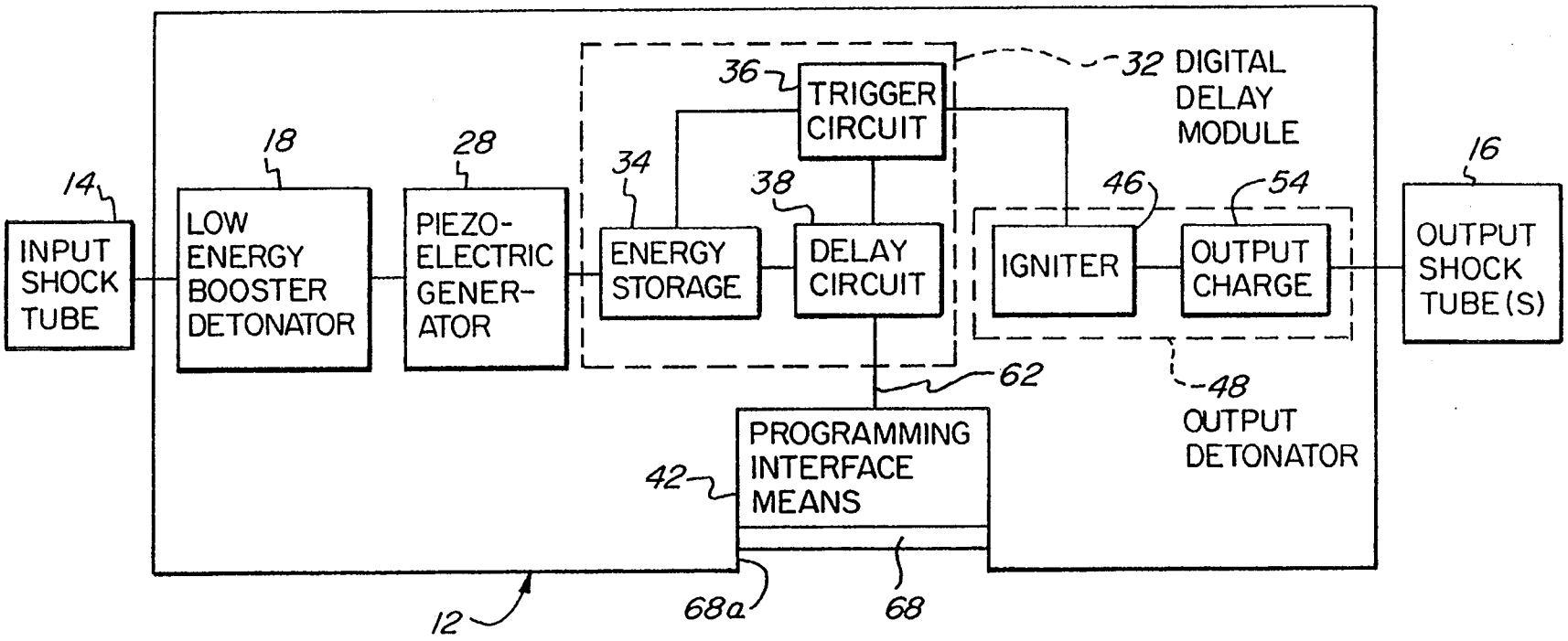
FIG. 2 is a schematic block diagram representing the structure of the embodiment of FIG. 1.

A buffer 25 is provided between the booster detonator shell 20 and piezoelectric generator 28. Buffer 25 is a dielectric material and serves to electrically isolate piezoelectric generator 28 from detonator shell 20. Piezoelectric generator 28 is thus located in close proximity to booster charge 26 with only shell 20 and buffer 25 intervening between them. Piezoelectric generator 28 comprises multiple alternating layers of a conductor and a piezoelectric ceramic wherein the metal layers are interconnected in parallel to form the output terminals (not shown) of piezoelectric generator 28. Leads 30*a*, 30*b* connect the output terminals of piezoelectric generator 28 to a delay module provided in the illustrated embodiment by digital delay module 32 (FIGS. 1 and 2). Referring to FIG. 2, digital delay module 32 includes an energy storage capacitor 34, a trigger circuit 36, a delay circuit 38, and a programming interface means 42 mounted thereon. Energy storage capacitor 34 is, in the illustrated embodiment, about a 3 micro-farad unit rated at 35 volts. Its series impedance is preferably low to accommodate the fast rise time of the 1 to 2 microsecond pulses generated by piezoelectric generator 28.

Figure 1B:
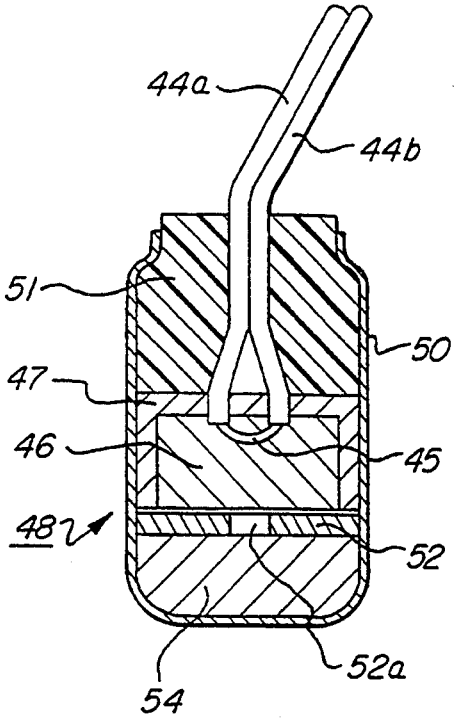
FIG. 1B is a view, enlarged relative to FIG. 1, of the output detonator of the delay unit of FIG. 1 and certain connections thereto.
Figure 1A:
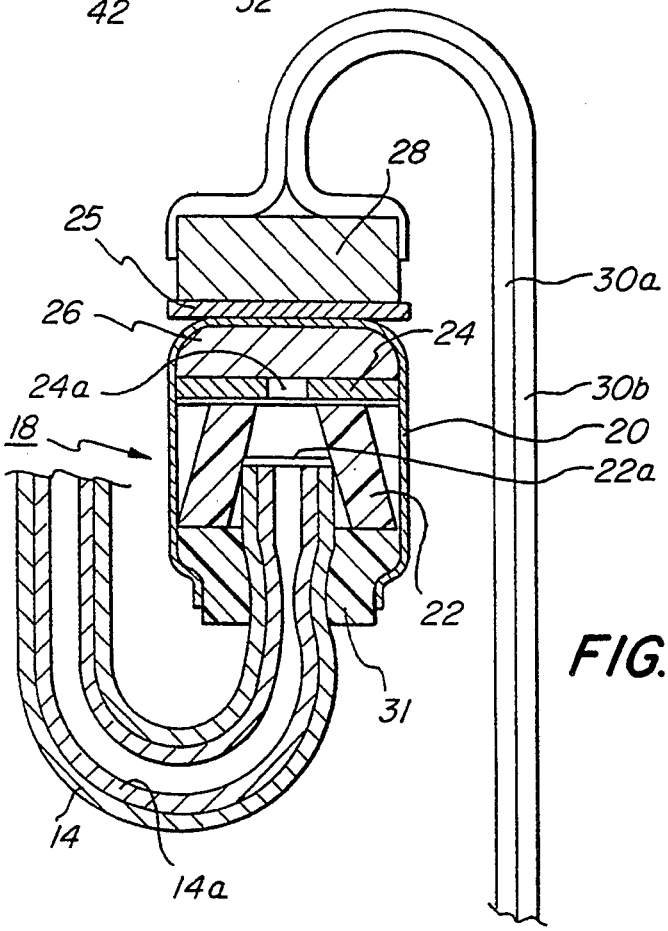
FIG. 1A is a view, enlarged relative to FIG. 1, of the low energy booster detonator of the delay unit of FIG. 1 and certain connections thereto.

Referring to FIGS. 1 and 1B, the output of digital delay module 32 is electrically connected by second conductor means to igniter element 46 of output detonator 48. In the illustrated embodiment (FIGS. 1 and 1B), the second conductor means comprise a pair of leads 44*a*, 44*b*, the ends of which are connected by a bridge wire 45 embedded within an igniter element 46 (FIG. 1B). As best seen in FIG. 1B, output detonator 48 comprises the igniter element 46 contained within an igniter cup 47 positioned within output detonator shell 50 in close proximity to an output charge 54. Leads 44*a*, 44*b* are retained within output detonator shell 50 by a bushing 51 held in place by the necked-down portion (unnumbered) of shell 50. A second cushion element 52 identical to first cushion element 24 abuts and separates igniter element 46 from output charge 54. Cushion element 52 contains a central aperture 52*a* which serves the same function as central aperture 24*a* of first cushion element 24 and is similarly closed with a thin, rupturable membrane (unnumbered) to seal output charge 54.

The end of housing 12 adjacent to output detonator 48 is configured to provide a plurality of output line retainer means for retaining one or more output transmission lines in proximity to output detonator 48. In the illustrated embodiment, these output line retainer means are provided by a combination of output line bores 56 and cleats 58. Output line bores 56 have entry mouths 56*a* and exit mouths 56*b*. Cleats 58 are generally hook-shaped, terminate in flexible lips 58*a*, and are located adjacent to and aligned with the exit mouths 56*b* of output line bores 56. Output line bores 56 and cleats 58 thus cooperate to provide the output line retainer means in the illustrated embodiment. Although only two such output line retainer means are illustrated in FIG. 1, it will be appreciated that more than two such output line retainer means could be provided. For example, in the illustrated embodiment, four or even six such output line retainer means could be evenly spaced about the periphery of housing 12.

One or more output transmission lines such as the illustrated output shock tube 16 may be secured to housing 12 in close proximity to output detonator 48 by means of the output line retainer means provided by output line bores 56 and cleats 58. Thus, shock tube 16 has a terminal end 16*a* which is closed and sealed against the environment by seal 16*b* which flattens and seals shock tube 16. A suitable detonator cap (not shown) is crimped onto the remote end (not shown) of shock tube 16 and may be emplaced within an explosive charge or may be utilized as a signal amplifying and transmitting cap to ignite another signal transmission tube to which it is connected. Obviously, any suitable length of output shock tube 16 may be employed and delay unit 10 may remain on the surface whether output shock tube 16 comprises a surface transmission line or a downhole line. Alternatively, delay unit 10 may be placed within a borehole, e.g., when it is used in conjunction with an instantaneous blasting cap to provide an accurate delay period for a downhole blasting cap. A period tag 16*c* is attached near the terminal end 16*a* of shock tube 16 to indicate the delay period of the detonator cap (not shown) attached to the remote end (not shown) of shock tube 16. In the illustrated embodiment, the legend "Period Zero" on period tag 16*c* indicates that the detonator cap attached to the remote end of shock tube 16 has no delay period, i.e., it is a zero period or instantaneous detonating cap. Obviously, depending on the design of a particular blasting pattern, the detonator cap at the remote end of shock tube 16 may, if desired, have an electronically controlled time delay period and such would be reflected in period tag 16*c*. A digital delay detonator cap of the type described in parent application Ser. No. 07/730,275 would provide an accurate cap delay period.

Shock tube 16 is easily and securely attached to housing 12 by bending the tube back on itself a short distance away from terminal end 16*a* so as to form a loop or bight in shock tube 16, and forcing the bight of the tube upwardly into entry mouth 56*a* of bore 56 and out through exit mouth 56*b* to protrude beyond mouth 56*b*. The bight is advanced to protrude a distance sufficient to enable folding over of the shock tube to bring the bight thereof beneath the associated cleat 58 in the vicinity of the lip 58*a* thereof. The overlapping lengths of the shock tube are then pulled downwardly in the direction of the unnumbered arrow in FIG. 1, to pull the bight of the tube upwardly past flexible lip 58*a* and thus seat the looped shock tube 16 firmly within cleat 58 as shown in FIG. 1. Additional output transmission tubes may be secured to the other output line retainer mean(s) of housing 12 in the same manner. The proximity of shock tube 16 (and of any other output transmission lines similarly attached to housing 12) to output detonator 48 assures that the detonation of output detonator 48 will initiate an output signal in the connected output transmission lines. The combination of output detonator 48 and igniter element 46 provides an electrically detonatable output charge.

A programming interface means 42, which may comprise any suitable electrical, optical or other programming interface means 42 is programmable from exteriorly of housing 12 and may be connected to digital delay module 32 by any suitable means represented by interface connector 62. A programming window 68 is formed in housing 12 against which a suitable programming interface means 42 (not shown), such as a hand-held programmer, may be placed to carry out programming of delay unit 10 to provide a selected delay period for it. A guide-ridge 68*a* is formed about the periphery of programming window 68 to guide placement and retention of the programming interface means 42 in proper alignment with programming window 68.

Interface connector 62 may comprise any suitable connector means, e.g., soldered electrical wires, which, in the illustrated embodiment, serve to connect programming interface means 42 to digital delay module 32 to enable the entry of a specific time delay into delay module 32. The power necessary to perform this function and the programming signal can be transferred by induction in a pick-up coil comprising part of programming interface means 42, in a well-known manner. In this way, programming interface means 42 need not have any external pins or metallic conductive means requiring one or more physical openings in housing 12. This helps to assure the integrity of housing 12 and the contents thereof against environmental and stray electric field effects.

If the programming of digital delay module 32 is to be performed via an optical path, a small battery having a long shelf life, such as a lithium battery, is provided to supply the power necessary for performing the programming function. The voltage and capacity of the battery is chosen to ensure that the energy available from the battery is not sufficient to trigger igniter element 46 in case of a malfunction.

In a typical embodiment, housing 12 is made of a nonconductive polymer that shields the internal components against both electrical signals and mechanical shocks that could inadvertently activate low energy booster detonator 18 or output detonator 48. To increase shielding effectiveness against electrical disturbances, conductive members (not shown) may be encased within the walls of housing 12 to provide a high degree of attenuation of magnetic or electrical fields thereby protecting the internal circuitry, including the programming circuits, by forming a Faraday cage around the electrically sensitive components. Alternatively, housing 12 may comprise a semi-conductive material to provide shielding for the circuitry components.

Assembly of the components may be carried out by encapsulating the components with potting compound within suitable recesses formed in housing 12, which may be generally cylindrical in configuration. Preferably, the input transmission line such as shock tube 14 will be factory-installed and sealed within housing 12. The delay unit of the present invention may thus be provided with only a suitable length of shock tube 14 (or other suitable input transmission line) attached thereto. In such case, the connections to output transmission tubes, such as illustrated output shock tube 16, may be made in the field as required. Alternatively, both input and output transmission lines may be factory-installed or field-assembled.

A cover (not shown in the drawings) may be provided for housing 12 to cover and seal the installed components. As a final step in the assembly of housing 12, the cover may be secured in place by integral clips, ultrasonic welding, solvent bonding, ultrasonic staking, or an adhesive in order to provide a moisture-tight enclosure protected from the environment.

Operation of the delay unit 10 of FIGS. 1 and 2 is described with reference to FIGS. 1, 2 and 4, the latter Figure showing details of one embodiment of the circuitry of delay module 32. Ignition of the input shock tube 14 delivers an impulse signal which ruptures the membrane of anti-static cup 22 and first cushion element 24 to impact upon booster charge 26 and detonate it. Piezoelectric generator 28 converts the shock energy delivered to it by the detonation of booster charge 26 into electrical energy which is delivered to digital delay module 32 via leads 30*a*, 30*b*. Digital delay module 32 stores the electrical energy delivered to it from piezoelectric generator 28 in capacitor 34. In the illustrated embodiment, piezoelectric generator 28 and energy storage capacitor 34, respectively, comprise the transducer and energy storage means which together comprise the signal conversion means of the present invention. The electrical energy stored in capacitor 34 is used in one embodiment for two purposes: the powering of the electronic timing of the digital delay module 32 and, after the preset time delay, the ignition of igniter element 46. More specifically, when the voltage of the electrical energy stored in capacitor 34 is above a selected threshhold, the logic and timer portion of the delay module 32 (FIG. 2) is energized.

Figure 4:
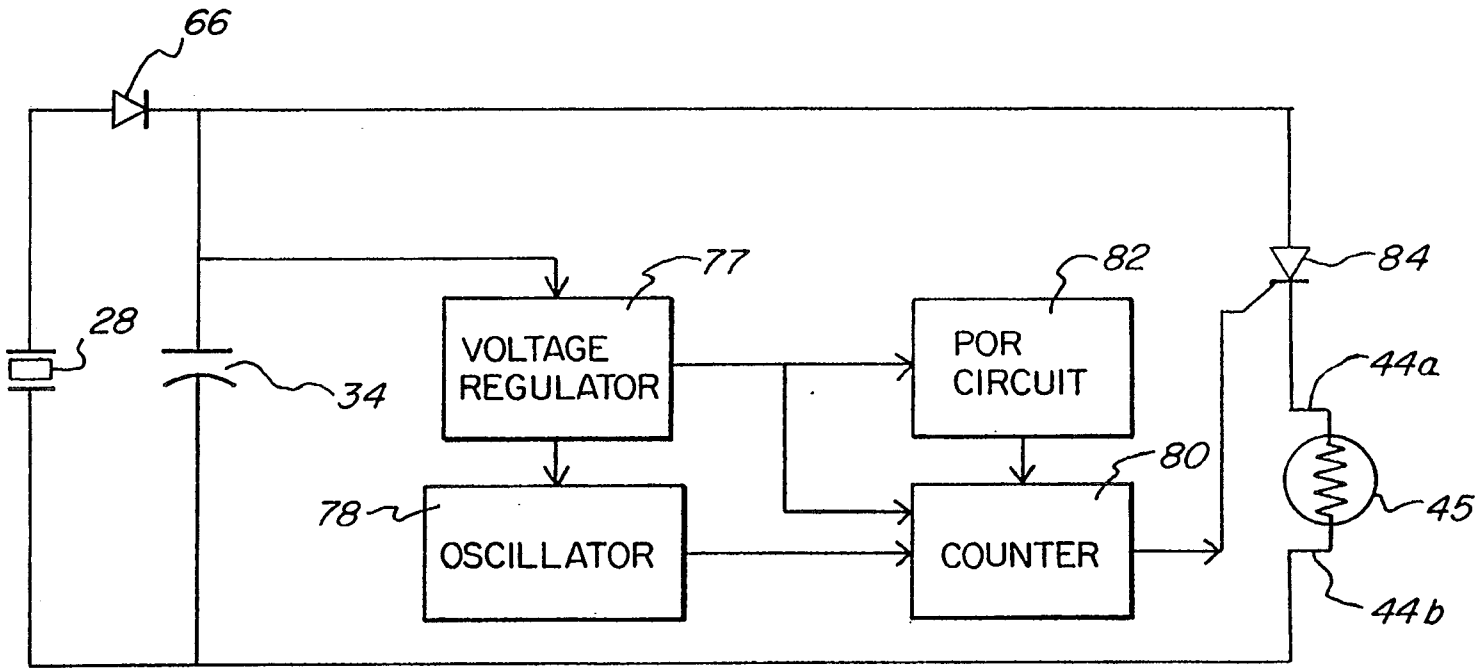
FIG. 4 is a schematic block diagram of one embodiment of a delay circuit utilizeable in accordance with the present invention, e.g., in the embodiments of FIGS. 1, 2 and 3.

Referring to FIG. 4, the first electric signal generated by piezoelectric generator 28 is transmitted through steering diode 66 to capacitor 34, which stores the electrical energy. When a predetermined minimum voltage is reached on capacitor 34, voltage regulator 77 is activated to apply a portion only of the power generated by piezoelectric generator 28 to the timing circuits of oscillator 78, counter 80, and power-on reset circuit 82. A silicon controlled rectifier ("SCR") 84 is activated by counter 80 at the conclusion of the timing interval, thereby supplying the remaining energy in capacitor 34 to the second conductor means provided, in the illustrated embodiment, by leads 44*a*, 44*b*.

During operation of the circuit of FIG. 4, the power-on reset circuit 82 preloads the counter 80 with count information from interface connector 62 (FIGS. 1 and 2) or, in an embodiment of the invention (not illustrated) which does not include a programming interface means such as programming interface means 42, preloads the counter with an initial preset count value. This preloading occurs at the time capacitor 34 receives the electrical signal from piezoelectric generator 28. Concurrently, oscillator 78 starts generating pulses (or cycles) that are counted by counter 80. As the counter 80, activated by the pulses from oscillator 78, reaches a preselected count as, for example, 1, the preprogrammed delay period expires and an activation signal is sent to SCR 84. The activation signal puts SCR 84 in a conducting state which allows it to conduct the electrical energy in capacitor 34 to leads 44*a*, 44*b* and bridge wire 45 which, in the illustrated embodiment, provide the second conductor means which serve to detonate igniter element 46 and thereby detonate output charge 54 (FIG. 1B) which, in turn, ignites the shock tube(s) 16 retained in proximity to detonator 48.

The arrival at SCR 84 from capacitor 34 of the energy needed to detonate output charge 54 is seen to be delayed by an interval essentially equal to the time required for the counter 80 to count the pulses from oscillator 78 from the initially preset amount from power-on reset circuit 82, to some value, for example, 1.

In other embodiments of the invention, a battery may be included in the circuit to supply energy for programming the time delay. In yet another embodiment, the battery energy may also be used not only for programming the time delay, but also for powering the delay circuits. However, in all embodiments of the invention, ignition of the output charge (item 54 in the embodiment illustrated in FIG. 1B) is powered by energy emitted from the transducer (piezoelectric generator 28 in the embodiment illustrated in FIG. 1A) and not by battery or other stored energy sources. The battery or other stored energy source utilized is of insufficient power to detonate the output charge. This provides a safety factor because the piezoelectric generator is designed to be actuated substantially only by the impulse signal imposed upon it by detonation of the booster charge (item 26 in the embodiment illustrated in FIG. 1A) or the detonating cord, described below in connection with the embodiment of FIG. 3. Thus, the transducer (e.g., the piezoelectric generator 28) is of sufficiently low sensitivity that mechanical shocks or vibration imposed upon it by rough handling, being dropped or impacted in normal or rough usage, or by nearby explosions, e.g., in an adjacent borehole, will not cause the transducer to be activated. Thus, the transducer will generate electric power sufficient to ignite the igniter element (item 46 in the embodiment illustrated in FIG. 1B) and thereby ignite the output charge (item 54 in the embodiment of FIG. 1B) to generate the outgoing signal substantially only by the input impulse signal or the amplification thereof by the booster charge (item 26 in the embodiment of FIG. 1A).

Figure 5:
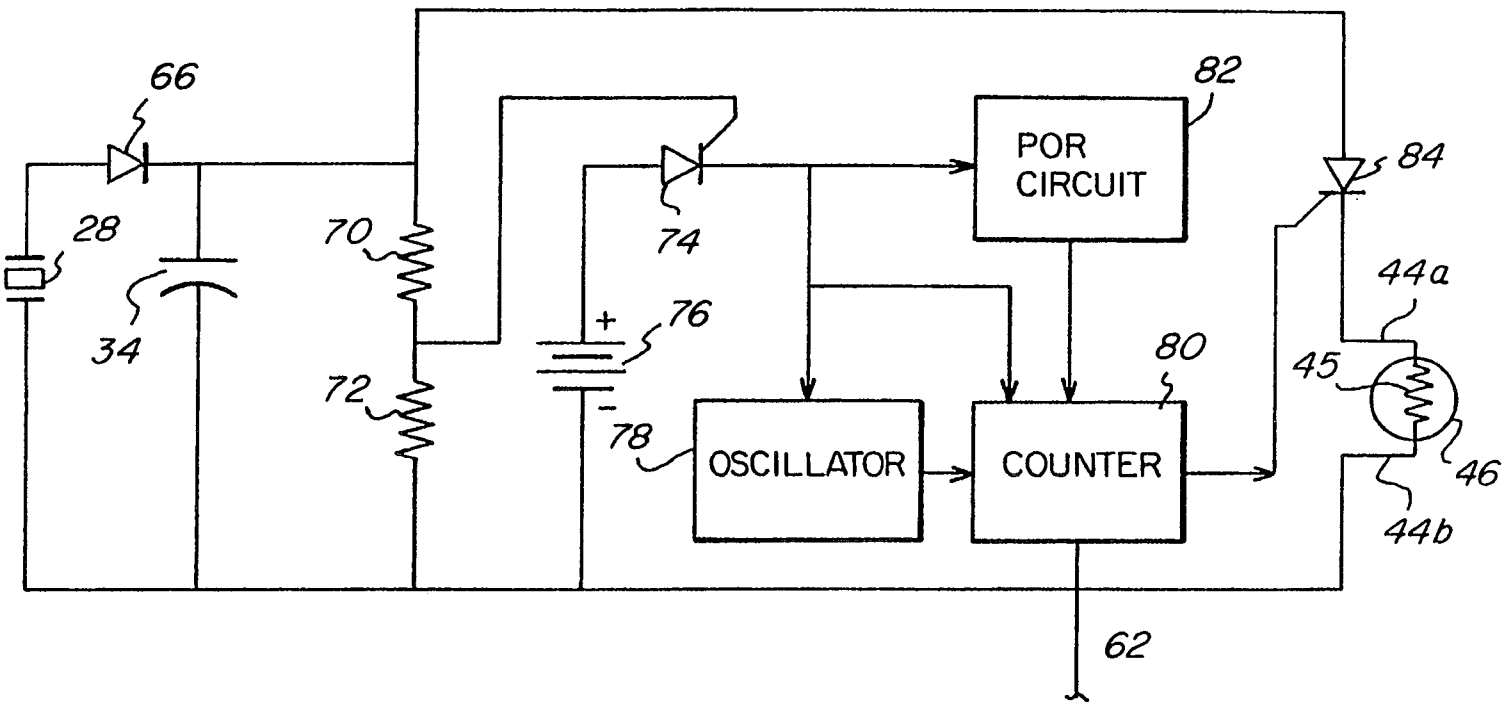
FIG. 5 is a schematic block diagram of another embodiment of a delay circuit utilizeable in accordance with the present invention, e.g., in the embodiments of FIGS. 1, 2 and 3.

Thus, in cases where a battery or other suitable stored energy source is provided, instead of using the power derived from the piezoelectric generator, e.g., piezoelectric generator 28 of the illustrated embodiments, for both the timing and ignition of the output charge (output charge 54 in the illustrated embodiments) the delay circuits are powered by a source, e.g., a battery, connected therethrough through a silicon controlled rectifier (SCR) switch which is activated by a signal derived from the energy output of the piezoelectric generator. An embodiment of the invention illustrating the utilization of battery power for both programming the time delay and powering the delay circuits is illustrated in FIG. 5. The utilization of battery power enables the provision of a much longer delay period than that which could be attained if the piezoelectric generator were the sole source of power.

Reference is now made to FIG. 5, wherein items identical or substantially the same as those of the embodiment of FIG. 4 are identically numbered as in FIG. 4, except for the addition of a prime indicator thereto. Referring now to FIG. 5, the first electric signal generated by piezoelectric generator 28' is transmitted through steering diode 66 to capacitor 34', which stores the electrical energy. The voltage reached by capacitor 34' is divided by resistors 70 and 72 to activate a silicon controlled rectifier (SCR) 74. Once activated, SCR 74 causes the power from a battery 76 to be applied to the timing circuits of oscillator 78', counter 80', and power-on reset circuit 82'. SCR 84' is activated by counter 80' at the conclusion of the timing interval, thereby supplying energy to the second conductor means provided, in the illustrated embodiment, by leads **44*a*, 44*b***.

Operation of the circuit of FIG. 5 is substantially the same as that described above with respect to the circuit of FIG. 4 except that, as noted above, the power for programming the time delay and powering the delay circuits is provided by the battery 76 and the power output of piezoelectric generator 28' is needed only to initiate the timing and detonate the output charge 54.

Further details of the operation of the present invention are illustrated in FIG. 2 which diagramatically shows input shock tube 14 for delivering a pressure input pulse to low energy booster detonator 18 which detonates to provide the amplified signal used to generate a pressure pulse on piezoelectric generator 28. Energy storage capacitor 34, trigger circuit 36 and delay circuit 38 are part of digital delay module 32. Piezoelectric generator 28 generates the first electric signal pulse in response to the pressure imposed on it from low energy booster detonator 18. This first electric signal is stored in an energy storage capacitor 34 to be subsequently used by trigger circuit 36 and delay circuit 38. Delay circuit 38 activates trigger circuit 36 after the time interval programmed into delay circuit 38 has elapsed. Trigger circuit 36 allows electrical energy stored in energy storage capacitor 34 to flow to igniter element 46, thereby triggering output charge 54 to generate a pressure output pulse large enough to initiate one or more output transmission lines such as shock tube(s) 16 which are retained in close proximity to output charge 54.

Delay circuit 38 communicates through interface connector 62 and programming interface means 42 with any suitable external means (not shown) placed against programming window 68 and oriented thereagainst by guideridge **68*a* (FIGS. 1 and 2). The signals from the external programmer means are encoded by any suitable well-known techniques to both power and pass delay information to delay circuit 38 via interface means 42 and interface connector 62. By way of illustration, an infra red emitter 60*a* and receiver 60*b* are shown in FIG. 1 as the means to provide communication between the external programmer means and interface means 42**.

Figure 3:
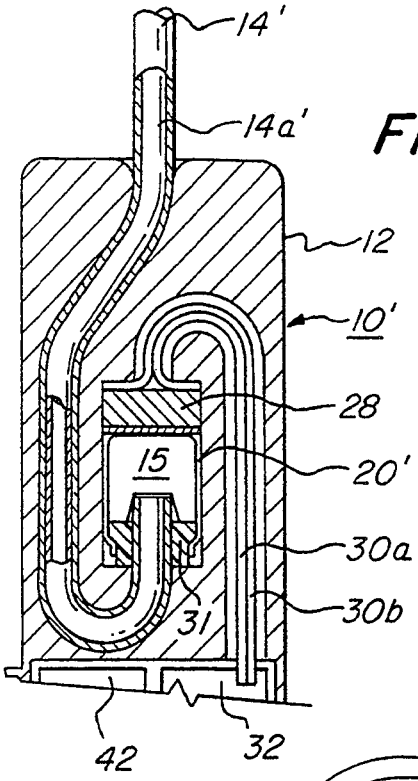
FIG. 3 is a schematic cross-sectional view corresponding to that of FIG. 1 but with parts broken away, showing another embodiment of the delay unit of the present invention including an input transmission line attached thereto.

FIG. 3 shows another embodiment of the present invention in which items similar to those of the embodiment of FIGS. 1 and 2 are identically numbered to those of FIG. 1 but with the addition of a prime indicator. Identical components are identically numbered. In the embodiment of FIG. 3, the input transmission line connected to delay unit 10' is provided by a low energy detonating cord 14', which is used in lieu of input shock tube 14 and booster charge 26 of the embodiment of FIGS. 1 and 2. In the illustrated embodiment of FIG. 3, detonating cord 14' is mounted in housing 12 in the same manner as shock tube 14 of the FIG. 1 embodiment, but terminates in opposite-facing proximity to piezoelectric generator 28 within a chamber 15 defined by detonator shell 20'. The impulse input signal required to activate the piezoelectric generator is provided in this embodiment directly by low power detonating cord 14'. The low power detonating cord has a solid explosive core **14*a'* of sufficiently low explosive power to ensure the preservation of the integrity of the housing 12 of the in-line delay unit 10'. Nonetheless, detonating cord 14' has sufficient explosive power to directly excite the piezoelectric generator 28 to produce electrical energy sufficient to generate the electric signal needed to detonate the output charge (not shown in FIG. 3). Piezoelectric generator 28 responds to the input impulse signal provided by the explosion shock wave generated by detonation of low power detonating cord 14' by generating electrical energy that is stored in energy storage capacitor 34 (not shown in FIG. 3). All the components of the embodiment of FIG. 3 other than as specifically set forth above, are identical to those illustrated in FIG. 1 and function in exactly the same manner. Therefore, it is not necessary to illustrate them in FIG. 3** or to repeat the description of their function.

It will be appreciated that the present invention thus provides an accurate time delay between an impulse input signal (flame front, pressure wave, explosion, etc.), i.e., a non-electric signal, carried by an input transmission line and an output impulse signal transmitted by one or more output transmission lines to, e.g., each borehole in a group of multiple boreholes.

Furthermore, the present invention provides for a field programmable delay detonator, adjustable in small time increments, thereby requiring only a single type of in-line delay unit to be kept in stock and used for the implementation of different in-line delays at a blasting site.

Although the present invention has been described in detail with respect to specific preferred embodiments thereof, various modifications thereto lie within the spirit and scope of the invention and the claims.

What is claimed is:

1. A delay unit comprising a housing having (i) input line retainer means for retaining an input transmission line capable of transmitting a non-electric input impulse signal; (ii) coupling means for coupling the input transmission line to signal conversion means for converting a non-electric input impulse signal from the input transmission line to electrical energy and releasing the electrical energy as a first electric signal and a subsequent second electric signal; (iii) first conductor means connecting the signal conversion means to a delay circuit for transmitting thereto the first electric signal to activate the delay circuit to start counting a selected time interval; (iv) second conductor means connecting the signal conversion means via the delay circuit to an electrically detonatable output charge for transmitting, upon lapse of the selected time interval, the second electric signal to detonate the output charge; and (v) one or more output line retainer means for retaining one or more output transmission lines in proximity to the output charge whereby detonation of the output charge ignites the one or more output transmission lines.

2. The delay unit of claim 1 wherein the coupling means comprises a booster charge which is positioned to be detonated by the impulse signal received from the input transmission line to pressurize at least a part of the signal conversion means and thereby generate the electrical energy.

3. The delay unit of claim 1 or claim 2 wherein the signal conversion means comprises a transducer for converting the input impulse signal to electrical energy and energy storage means connected to the transducer to receive electrical energy for release as the first electrical signal and the second electrical signal.

4. The delay unit of claim 3 wherein the coupling means comprises the booster charge and the transducer is pressurized by detonation of the booster charge.

5. The delay unit of claim 3 wherein the transducer comprises a piezoelectric generator.

6. The delay unit of claim 4 wherein the energy storage means comprises a storage capacitor.

7. The delay unit of claim 3 wherein the delay circuit comprises a voltage regulator connected to the energy storage means to receive power therefrom, an oscillator for generating cycles connected to the voltage regulator to receive power therefrom, a counter connected to the oscillator for counting the cycles, and means for preloading the counter with an initial value.

8. The delay unit of claim 3 further including programming means carried by the housing and effective to program the duration of the time interval of the delay circuit.

9. The delay unit of claim 8 wherein the programming means is accessible from the exterior of the housing and further including an interface connector connecting the programming means to the delay circuit whereby the duration of the time interval of the delay circuit may be programmed.

10. The delay unit of claim 9 wherein the interface connector comprises an inductive pick-up means.

11. The delay unit of claim 9 wherein the interface connector comprises an optical coupling means.

12. The delay unit of claim 3 including an input transmission line retained by the input line retainer means.

13. The delay unit of claim 12 further including one or more output transmission lines retained by the output line retainer means.

14. The delay unit of claim 13 wherein the one or more output transmission lines comprise output transmission tubes.

15. The delay unit of claim 12 wherein the input transmission line comprises an input transmission tube.

16. The delay unit of claim 15 wherein the input transmission tube comprises a shock tube.

17. A method for interposing a time delay between the application of a non-electric input impulse signal received from an input transmission line and the generation of one or more output impulse signals via one or more output transmission lines, comprising the steps of:

(a) converting the non-electric input impulse signal to a first electric signal;

(b) transmitting the first electric signal to an oscillator;

(c) counting the number of cycles generated by the oscillator in response to the first electric signal;

(d) generating a second electric signal upon the completion of a preprogrammed count of the number of cycles;

(e) transmitting the second electric signal to an electrically operable output charge to detonate the output charge; and (f) igniting one or more output transmission lines with the energy generated by the output charge to transmit one or more output impulse signals.

18. The method of claim 17 including carrying out step (a) by pressurizing a piezoelectric generator with the input impulse signal.

19. The method of claim 18 including amplifying the input impulse signal by using it to detonate a booster charge which pressurizes the piezoelectric generator.

20. The method of claim 17, claim 18 or claim 19 including transmitting the input impulse signal and the output impulse signals by means of transmission tubes.

21. The method of claim 17, claim 18 or claim 19 including supplying power to the oscillator from a battery means.

22. The method of claim 17, claim 18 or claim 21 including supplying power to the oscillator from a battery means which has insufficient power to detonate the output charge.

23. A delay unit comprising a housing having (i) input line retainer means for retaining an input transmission line capable of transmitting a non-electric input impulse signal; (ii) coupling means for coupling the input transmission line to signal conversion means for converting a non-electric input impulse signal from the input transmission line to electrical energy and releasing the electrical energy as a first electric signal and a subsequent second electric signal; (iii) first conductor means connecting the signal conversion means to a delay circuit for transmitting thereto the first electric signal to activate the delay circuit to start counting a selected time interval, the delay circuit comprising a battery means to supply power to the delay circuit upon the activation thereof; (iv) second conductor means connecting the signal conversion means via the delay circuit to an electrically detonatable output charge for transmitting, upon lapse of the selected time interval, the second electric signal to detonate the output charge; and (v) one or more output line retainer means for retaining one or more output transmission lines in proximity to the output charge whereby detonation of the output charge ignites the one or more output transmission lines.

24. The delay unit of claim 23 wherein the battery means has insufficient power to detonate the output charge.

25. The delay unit of claim 23 or claim 24 wherein the signal conversion means comprises a transducer for converting the input impulse signal to electrical energy and energy storage means connected to the transducer to receive electrical energy for release as the first electrical signal and the second electrical signal.

26. The delay unit of claim 23 or claim 24 wherein the delay circuit comprises a voltage regulator connected to the energy storage means to receive power therefrom, an oscillator for generating cycles connected to the voltage regulator to receive power therefrom, a counter connected to the oscillator for counting the cycles, and means for preloading the counter with an initial value.

27. The delay unit of claim 26 wherein the delay circuit comprises the battery means connected to an oscillator to provide power thereto for generating cycles, a counter connected to the oscillator for counting the cycles, and means for preloading the counter with an initial value.

28. The delay unit of claim 23 or claim 24 further including programming means carried by the housing and effective to program the duration of the time interval of the delay circuit.

29. The delay unit of claim 23 or claim 24 wherein the programming means is accessible from the exterior of the housing and further including an interface connector connecting the programming means to the delay circuit whereby the duration of the time interval of the delay circuit may be programmed.

* * * * *

UNITED STATES PATENT AND TRADEMARK OFFICE

CERTIFICATE OF CORRECTION

PATENT NO. : 5,377,592

DATED : January 3, 1995

INVENTOR(S) : Kenneth A. Rode et al

It is certified that error appears in the above-indentified patent and that said Letters Patent is hereby corrected as shown below:

In The Abstract
At line 6, delete "lay".

In column 1, line 4, between "This" and "is", insert --application--.
In column 1, line 4, between "copending" and "application" insert --U.S.--.
In column 1, line 5, replace "tions" with --tion--.
In column 1, line 5, between "1991" and "now" insert --, entitled "Digital Delay Detonator",--.
In column 4, line 31, replace "valve" with --value--.
In column 6, line 22, replace "12" with --18--.
In column 12, line 11, replace "guideridge" with --guide ridge--.

Column 14, lines 4 and 44:
In claim 14, replace "13" with --12--.
In claim 22, replace "21" with --19--.

Signed and Sealed this

Twenty-sixth Day of September, 1995

Bruce Lehman

*Attest:*

BRUCE LEHMAN

*Attesting Officer*

*Commissioner of Patents and Trademarks*